US007478444B1

(12) United States Patent
Darrigo

(10) Patent No.: US 7,478,444 B1
(45) Date of Patent: Jan. 20, 2009

(54) PATIENT TRANSFER DEVICE

(76) Inventor: James Darrigo, 38 N. Plank Rd., Newburgh, NY (US) 12550

( * ) Notice: Subject to any disclaimer, the term of this patent is extended or adjusted under 35 U.S.C. 154(b) by 267 days.

(21) Appl. No.: 11/586,123

(22) Filed: Oct. 25, 2006

Related U.S. Application Data

(60) Provisional application No. 60/775,993, filed on Oct. 26, 2005.

(51) Int. Cl.
*A61G 7/14* (2006.01)

(52) U.S. Cl. ..... 5/81.1 HS; 5/625; 280/32.6

(58) Field of Classification Search ..... 5/81.1 HS, 5/81.1 R, 81.1 C, 625, 628, 626; 280/32.6, 280/79.11; 193/35 MD
See application file for complete search history.

(56) References Cited

U.S. PATENT DOCUMENTS 1,531,536 A * 3/1925 Benz ..... 280/32.6
1,572,273 A * 2/1926 Elton ..... 280/87.051
1,823,526 A * 9/1931 Breeden ..... 280/32.6
3,285,447 A * 11/1966 Junion ..... 414/469
4,262,375 A 4/1981 Lilienthal
4,909,524 A * 3/1990 Paine ..... 280/18
4,970,738 A 11/1990 Cole
5,152,016 A * 10/1992 Becker ..... 5/81.1 HS
5,580,074 A * 12/1996 Moreno ..... 280/79.11
7,182,351 B2 * 2/2007 Williams ..... 280/87.021
2005/0102748 A1 5/2005 Johnson

* cited by examiner

*Primary Examiner*—Alexander Grosz
(74) *Attorney, Agent, or Firm*—Marajama Muldoon Blasiak & Sullivan LLP

(57) ABSTRACT

The invention provides a convenient, compact and light-weight patient transfer device for transferring patients between two horizontal surfaces such as from bed to bed, bed to stretcher, stretcher to gurney, etc. One person can lift or maneuver the device under a patient with a minimum of effort, with ergonomic safety, and little chance of injury or strain. The device comprises a generally flat and semi-rigid support member adapted to be orientated in a generally horizontal disposition, apertures or other non-protruding handles along the sides of the support member spaced shoulder-width apart, fasteners for securing the patient on the support member, and omnidirectional rollers positioned on the lower surface of the support member for translating the support member across the generally horizontally disposed surface and transferring the patient to or from one horizontal surface to another.

9 Claims, 2 Drawing Sheets

PATIENT TRANSFER DEVICE

CROSS-REFERENCE TO RELATED APPLICATIONS

Figure 1:
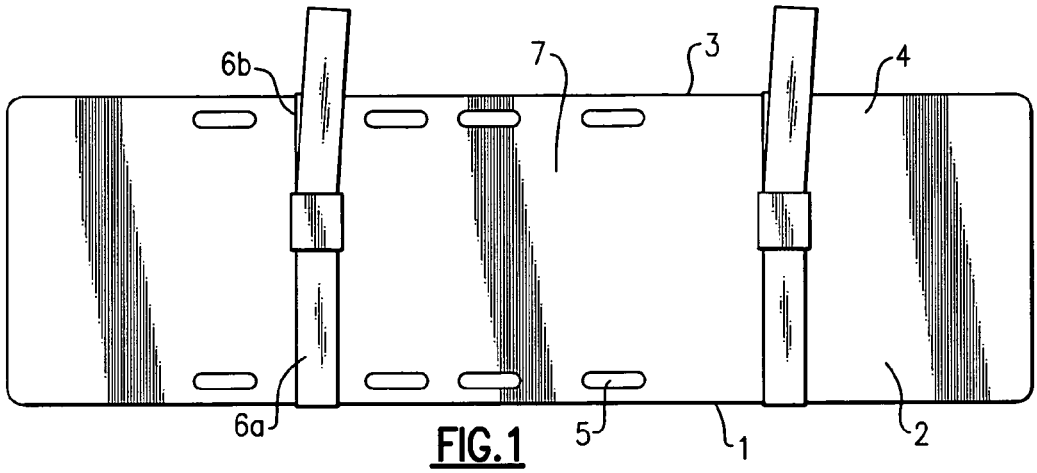

This application claims priority to and the benefit of U.S. provisional patent application Ser. No. 60/775,993, filed Oct. 26, 2005, which is incorporated herein by reference in its entirety.

STATEMENT REGARDING FEDERALLY SPONSORED RESEARCH OR DEVELOPMENT

Not applicable

REFERENCE TO APPENDIX

Not applicable

1. TECHNICAL FIELD

The present invention relates to a device for transferring an object to and from a generally horizontally disposed surface. The present invention also relates to a patient transfer device.

2. BACKGROUND OF THE INVENTION

Nurses, doctors, orderlies, physical therapists and other caregivers working and assisting patients in hospitals, nursing homes, and home care environments are frequently called upon to assist in patient transfer. The process of transferring a sick, invalid or bedridden patient from a bed to another horizontal surface, such as a gurney, stretcher, or examination table, is frequently time-consuming and cumbersome, and typically involves more than one person to assist in the transfer. Such patient transfers can also be physically demanding and require much physical strength, painful or even injurious, for both the patient and the person(s) assisting the transfer. The difficulties encountered by caregivers in moving a bedridden patient in a home care setting can frequently result in the decision to move the patient from home to a hospital, nursing home, or skilled nursing care facility, and hence, result in incurring much greater health care expenses and emotional distress to both caregiver and patient.

There is therefore a need in the art for a lightweight, portable, patient transfer device that can be employed by one person to transfer a patient, without requiring considerable strength or skill.

Citation or identification of any reference in Section 2, or in any other section of this application, shall not be considered an admission that such reference is available as prior art to the present invention.

3. SUMMARY OF THE INVENTION

The invention provides a device for transferring an object to and from a generally horizontally disposed surface comprising:

a. a generally flat and semi-rigid support member adapted to be orientated in a generally horizontal disposition having i. a first edge, ii. a first side disposed medial to the first edge, iii. a second edge, wherein the second edge is opposite the first edge, iv. a second side disposed medial to the second edge, wherein the second side is opposite the first side, v. an upper surface, and vi. a lower surface, wherein the lower surface is opposite the upper surface;

b. a plurality of handle means;

c. fastening means; and d. a plurality of rolling means for translating the support member across the generally horizontally disposed surface, wherein the plurality of rolling means is positioned on the lower surface of the support member.

In one embodiment, the support member comprises a thermoplastic synthetic resin.

In another embodiment, the support member is ⅛ to ¼ inch thick.

In another embodiment, the support member is 20-36 inches wide and 65-84 inches long.

In another embodiment, the handle means is an aperture in the support member 1 inch wide and 4 inches long.

In another embodiment, the plurality of handle means is situated on the first or second side of the support member.

In another embodiment, the fastening means is a plurality of pairs of fastening means, each of the pairs of fastening means comprising a first fastening means having a first end and a second end and a second fastening means having a first end and a second end wherein a. the first end of the first fastening means of each of the pairs of fastening means is attached to the first side of the support member, b. the first end of the second fastening means of each of the pairs of fastening means is attached to the second side of the support member, c. the second end of the first fastening means is capable of attaching across the upper surface of the support member to the second end of the second fastening means, and d. the second end of the second fastening means is capable of attaching across the upper surface of the support member to the second end of the first fastening means across the upper surface of the support member.

In another embodiment, the plurality of pairs of fastening means is at least two pairs of straps.

In another embodiment, the second end of the first strap and the second end of the second strap of one pair of finite length straps are capable of attaching to one another diagonally.

In another embodiment, the rolling means is an omnidirectional ball roller.

In another embodiment, the omnidirectional ball roller is a solid thermoplastic resin ball roller.

In another embodiment, the plurality of rolling means is distributed in an anterior to posterior direction in parallel rows along the first and second sides of the lower surface of the support member.

In another embodiment, the object is a human being.

In another embodiment, the object is an animal.

The invention also provides a method for transferring an object (for example, a patient) to and from a generally horizontally disposed surface using the transfer device described herein. In one embodiment, the method comprises:

providing a transfer device, wherein the transfer device comprises a generally flat and semi-rigid support member adapted to be orientated in a generally horizontal disposition having i. a first edge, ii. a first side disposed medial to the first edge, iii. a second edge, wherein the second edge is opposite the first edge, iv. a second side disposed medial to the second edge, wherein the second side is opposite the first side, v. an upper surface, and vi. a lower surface, wherein the lower surface is opposite the upper surface;

a plurality of handle means;

fastening means; and a plurality of rolling means for translating the support member across the generally horizontally disposed surface, wherein the plurality of rolling means is positioned on the lower surface of the support member;

positioning the upper surface of the device under the object whereby the object is fully supported by the device; and rolling the device to (or from) the generally horizontally disposed surface, thereby transferring the object from (or to) the generally horizontally disposed surface.

4. BRIEF DESCRIPTION OF THE DRAWINGS

The present invention is described herein with reference to the accompanying drawings, in which similar reference characters denote similar elements throughout the several views. It is to be understood that in some instances, various aspects of the invention may be shown exaggerated or enlarged to facilitate an understanding of the invention.

FIG. 1 shows a schematic diagram of one embodiment of the patient transfer device of the invention, viewed from above. The anterior or head end of the device is towards the left of the diagram and the posterior or foot end of the device is towards the right of the diagram. 1, first edge of the support member. 2, first side of the support member, which is disposed immediately medial to the first edge and extends to the midline (i.e., the anterior-posterior axis) of the support member. 3, second edge of the support member. 4, second side of the support member, which is disposed immediately medial to the second edge and extends to the midline. 5, handle means. In this specific embodiment, an aperture in the support member 1 inch wide and 4 inches long serves as handle means. 6, fastening means. In this specific embodiment, fastening means are two pairs of straps (one pair of straps is labeled as 6*a* and 6*b*); each member of each pair of straps is attached to an opposite side of the lower surface of the support member. According to this embodiment, the straps fasten across the body of a patient lying on the upper surface of the support member and are secured with a buckle. 7, support member, upper surface. In this embodiment of the invention, the support member is 20 inches wide and 65 inches long.

Figure 2:
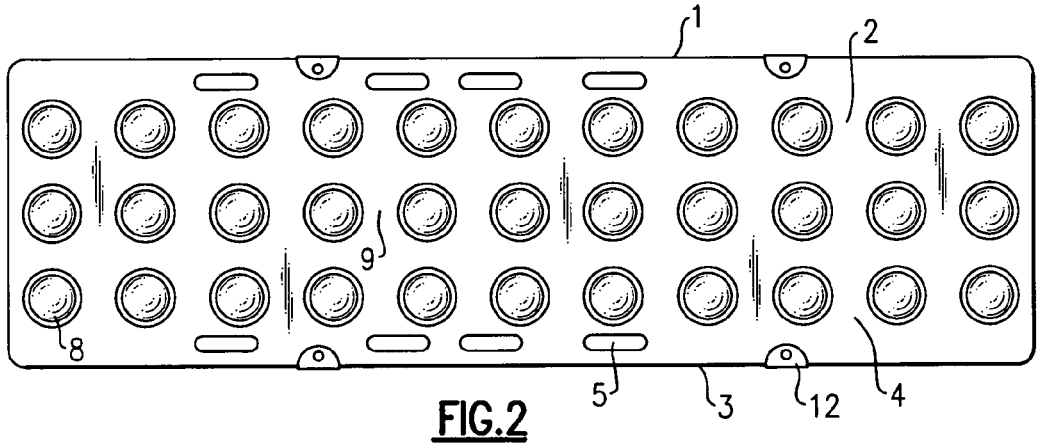

FIG. 2 shows a schematic diagram of the same embodiment of the patient transfer device of the invention as shown in FIG. 1, viewed from below. 1, first edge of the support member. 2, first side of the support member, which is disposed immediately medial to the first edge and extends to the midline. 3, second edge of the support member. 4, second side of the support member, which is disposed immediately medial to the second edge and extends to the midline. 5, handle means (aperture). 8, rolling means. In this embodiment of the invention, rolling means are omnidirectional ball rollers, and a plurality of 33 ball rollers are arranged in three rows on the lower surface 9 of the support member. In this diagram, the ball rollers depicted are 3 inches in diameter and distributed at evenly spaced intervals so that within a row running anterior-posterior, there is a 2-3-inch (identical) space between each roller (from the edge or side of one roller to the beginning of the next) and a 2-4 inch (identical) space between rows (from the edge or side of one roller to the beginning of the next). There is at least a 1-inch space between the first edge and the row of ball rollers running along the first side, at least a 1-inch space between the second edge and the row of ball rollers running along the second side, and at least 1-inch spaces between the anterior-most roller and the anterior edge and the posterior-most roller and the posterior edge. 9, support member, lower surface. 12, attachment point for the first end of one of the fastening means on the lower surface of the support member.

Figure 3:
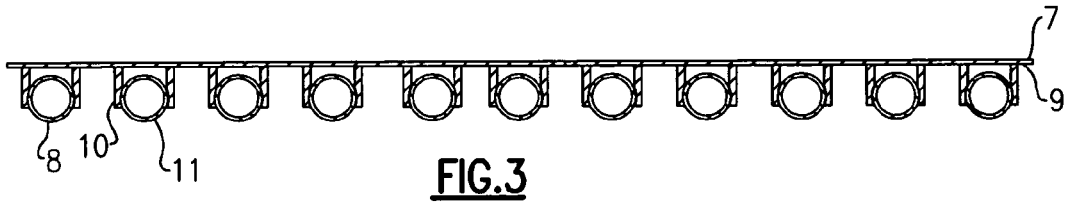

FIG. 3 shows a schematic diagram of the same embodiment of the patient transfer device of the invention as shown in FIGS. 1-2, viewed from the side. The thickness of the support member in this embodiment of the invention is ⅛ to ¼ inch thick. 7, upper surface of the support member. 8, rolling means. In this embodiment, the rolling means is an omnidirectional ball roller about 3 inches in diameter that is fabricated from acrylic and weighs about 5 oz. 9, lower surface of the support member. 10, housing of the omnidirectional ball roller. 11, ball of the omnidirectional ball roller. The omnidirectional ball rollers 11 are rotatably positioned in cylindrical extensions extending downwardly from the lower surface of the support member, as best seen in FIG. 4.

Figure 4:
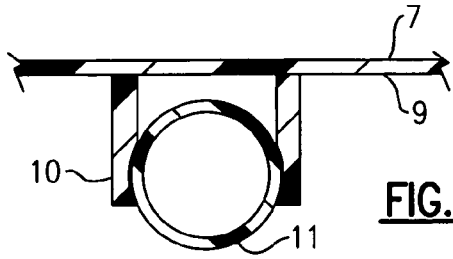

FIG. 4 shows an enlarged view of the omnidirectional ball roller shown in FIG. 3, viewed from the side. 7, upper surface of the support member. 9, lower surface of the support member. 10, housing of the omnidirectional ball roller. 11, ball of the omnidirectional ball roller.

Figure 5:
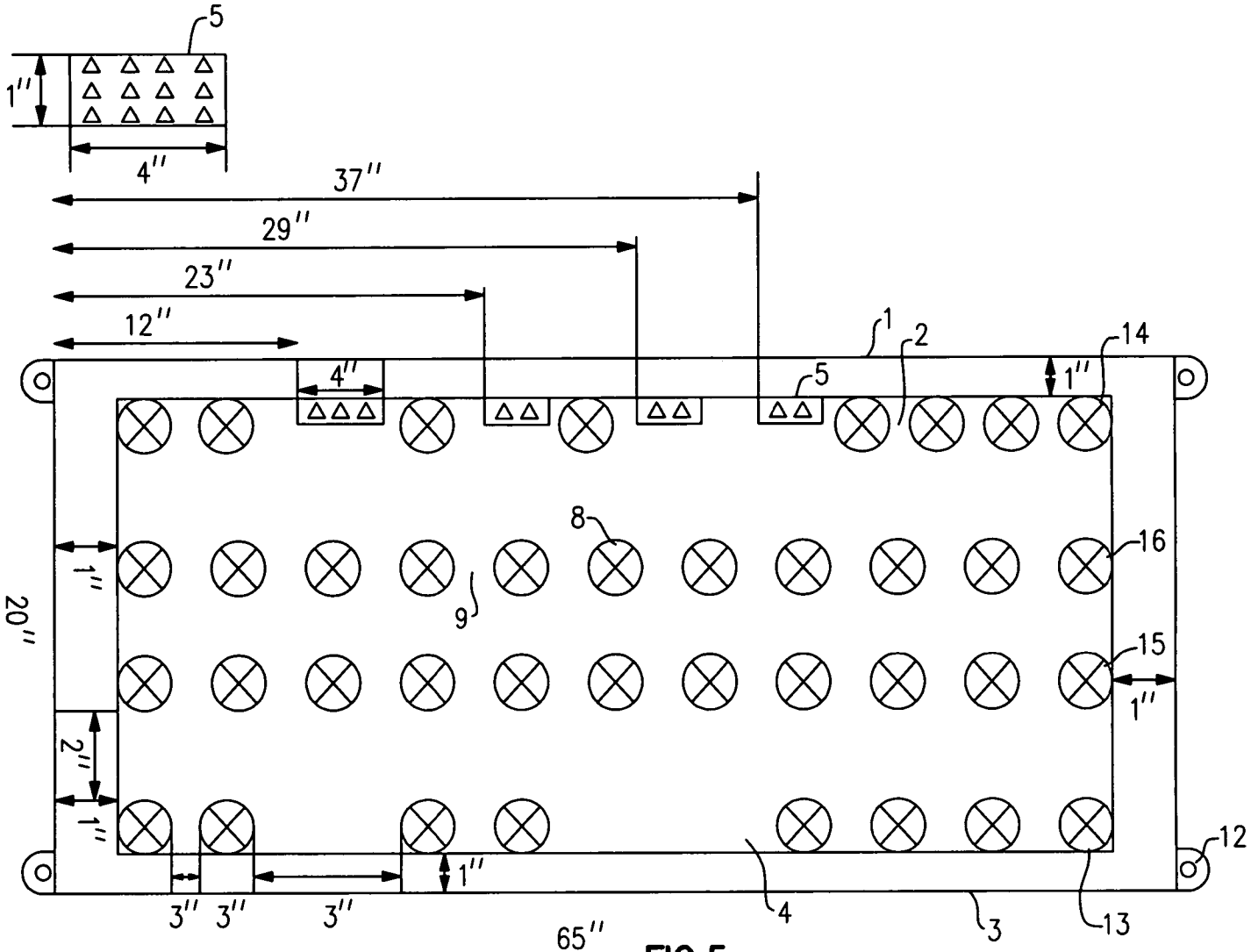

FIG. 5 shows a schematic diagram of another embodiment of the patient transfer device of the invention, viewed from below. The anterior or head end of the device is towards the left of the diagram and the posterior or foot end of the device is towards the right of the diagram. In this embodiment, the support member is 20 inches wide and 65 inches long. The rolling means, 8, which are omnidirectional ball rollers 3 inches in diameter, are arranged in four parallel anterior-posterior rows on the lower surface, 9, of the support member. Each rolling means is spaced 3 inches apart. The lateral edge of one ("edge") row of rolling means, 13, is situated 1 inch medial to the first edge on the first side, and the lateral edge of another ("edge") row of rolling means, 14, is situated 1 inch medial to the second edge on the second side. Two additional "interior" rows of rolling means (15, 16) run anterior-posterior, and are disposed lateral to the midline, one row running anterior-posterior on the first side and one row running anterior-posterior on the second side. There is a 2-inch space between the interior row (15, 16) on each side and the edge row (13, 14) on each side. There is a 1-inch space between the anterior edge and the first rolling means in each row, and 1-inch space between the posterior edge and the last rolling means in each row. In this embodiment, the fastening means are straps that attach to the corners of the support member (12) and fasten diagonally. Handle means, 5, are situated 1 inch medial to the first edge on the first side at 12 inches, 23 inches, 29 inches and 37 inches posterior to the anterior edge. In other embodiments, a second, corresponding set of handle means is situated 1 inch medial to the second edge on the second side at 12 inches, 23 inches, 29 inches and 37 inches posterior to the anterior edge. An enlarged diagram of one of the handle means, 5, a 1-inch wide by 4-inch long aperture in the support member, is shown in the upper left. 1, first edge of the support member. 2, first side of the support member, which is disposed immediately medial to the first edge and extends to the midline. 3, second edge of the support member. 4, second side of the support member, which is disposed immediately medial to the second edge and extends to the midline. 5, handle means (aperture). 12, attachment point for the first end of one of the fastening means.

5. DETAILED DESCRIPTION OF THE INVENTION

The invention provides a convenient, compact and lightweight patient transfer device for transferring patients between two horizontal surfaces such as from bed to bed, bed to stretcher, stretcher to gurney, etc. One person can lift or maneuver the device under a patient with a minimum of effort, with ergonomic safety, and little chance of injury or strain. The device comprises a generally flat and semi-rigid support member adapted to be orientated in a generally horizontal disposition, apertures or other non-protruding handles along the sides of the support member spaced shoulder-width apart, fastening means for securing the patient on the support member, and rolling means positioned on the lower surface of the support member for translating the support member across the generally horizontally disposed surface and transferring the patient to or from one horizontal surface to another.

In one embodiment, the invention provides a device for transferring an object (such as a human being) to and from a generally horizontally disposed surface comprising:

a. a generally flat and semi-rigid support member adapted to be orientated in a generally horizontal disposition having i. a first edge, ii. a first side disposed medial to the first edge, iii. a second edge, wherein the second edge is opposite the first edge, iv. a second side disposed medial to the second edge, wherein the second side is opposite the first side, v. an upper surface, and vi. a lower surface, wherein the lower surface is opposite the upper surface;

b. a plurality of handle means;

c. fastening means; and d. a plurality of rolling means for translating the support member across the generally horizontally disposed surface, wherein the plurality of rolling means is positioned on the lower surface of the support member.

When used in a medical or medically related facility, the invention provides means for transferring and/or transporting patients that is easier and safer than currently available patient transfer or transportation devices.

The invention provides a convenient and easily used patient transfer device for transporting patients safely and comfortably between two generally horizontal surfaces. Such a horizontal surface can be, for example, a horizontal surface encountered in a medical, veterinary, patient-care facility or home care setting, such as a bed, stretcher, gurney, or examination table. The patient transfer device of the invention can be used for example, to transport or transfer a patient from bed to bed, bed to stretcher, stretcher to bed, stretcher to stretcher, stretcher to gurney, etc.

The patient transfer device of the invention enables both patient and care provider (e.g., doctor, nurse, emergency medical personnel, home health care provider) to experience a greater degree of safety and convenience in patient transfer or transportation.

Because the patient transfer device is lightweight, compact, easy to maneuver, and has a smooth surface, its use can decrease the number of injuries of patients and personnel in medical facilities, assisted living and retirement facilities, nursing and rehabilitation facilities, home health care settings, emergency medical settings such as those in schools, sports facilities and ambulances, and in the work force in general. The invention provides efficient means for the transportation or transfer of patients without risk of injury to either patient or person(s) effecting the transfer of the patient.

In one embodiment, the object is a human being or an animal (such as a domestic or zoo animal) and the human being or animal is in a supine or prone position or lying on one side on a horizontal surface. In another embodiment, the person is a patient in a medical (or other health care or treatment) facility. In another embodiment, the patient is an invalid or has difficulty sitting up, walking or standing.

The patient transfer device of the invention has many advantages over currently existing devices. It is compact and lightweight, and can be easily transported or stored. In one embodiment, it weighs between 8 and 20 lbs.

The patient transfer device provided by the invention is simple in design, with few adjustable or moving parts that can require maintenance or safety checks. One person can lift or maneuver the device under a patient with a minimum of effort, with ergonomic safety, and with little chance of injury or strain.

For clarity of disclosure, and not by way of limitation, the detailed description of the invention is divided into the subsections set forth below.

5.1. Support Member

The present invention provides a device for transferring an object to and from a generally horizontally disposed surface. The horizontal support surface can be, for example, a bed, a stretcher, a gurney, a table (e.g., an examination table or patient treatment or examination surface).

The invention comprises a support member, wherein the support member comprises a i. a first edge, ii. a first side disposed medial to the first edge, iii. a second edge, wherein the second edge is opposite the first edge, iv. a second side disposed medial to the second edge, wherein the second side is opposite the first side, v. an upper surface, and vi. a lower surface, wherein the lower surface is opposite the upper surface.

The support member is a generally flat and semi-rigid support or load carrying member or deck structure that is adapted, by methods well known in the art, to be orientated in a generally horizontal disposition.

The support member is also designed, by methods well known in the art, to support a force exerted by the weight of the object to be transferred, e.g., the weight of a human body. In one embodiment, the support member is capable of supporting a load of 150-300 lb. In another embodiment, the support member is capable of supporting a load of at least 150, 250, 350 or 500 lb.

The support member can be composed of any material known in the art suitable for the construction of a lightweight, flat, semi-rigid surface, such as a lightweight metal (e.g., aluminum, lightweight steel or stainless steel), plastic, composite, resin, rigid foam (e.g., self-skinning injection molded plastic foam), lightweight wood or fiberboard, etc. In certain embodiments, the thickness of the support member is 1/16 to 1 inch thick. The support member preferably weighs 8 lbs or less.

In a preferred embodiment, the support member comprises a thermoplastic synthetic resin, such as polymethylmethacrylate or PLEXIGLAS®. In another preferred embodiment, the support member is composed of a thermoplastic synthetic resin 1/8 to 1/4 inch thick and weighs 8 lbs or less.

In another embodiment, the support member comprises lightweight aircraft-grade aluminum. In a specific embodiment, the lightweight aircraft-grade aluminum is about ⅛ to ¼ inch thick.

In another embodiment, the support member is an oblong, having a somewhat elongated form with two lateral edges running approximately parallel along the length of the support member (these are also referred to herein as a first edge and a second edge, without reference to left/right orientation), and an anterior ("head") edge and a posterior ("foot") edge running approximately parallel across the width of the support member.

In another embodiment, the first and second edges are not parallel, but are closer together at one end of the oblong than at the other.

In another embodiment, the support member is rectangular in shape (FIGS. 1-2). In a preferred embodiment, the oblong or rectangle has the approximate dimensions of a prone or supine adult human being (or of an adult human being lying on one side), e.g., 20-36 inches wide and 6½ to 7 feet long. In another embodiment, the support member is 20 inches wide and 65 inches long. In another embodiment, the support member is 27 inches wide and 65 to 84 inches long.

In two specific embodiments of the invention, depicted in FIGS. 1-4, and in FIG. 5, the support member is 20 inches wide and 65 inches long. Such dimensions can be easily altered by the skilled practitioner to reflect the dimensions of a child or of a larger- or smaller-than-average size adult human being.

In another embodiment, the oblong or rectangle has the approximate length and width dimensions of a domestic (or zoo) animal, for example, a large dog, large cat, pig, sheep, goat, horse, cow, deer, antelope, etc., that is prone, supine, or lying on one side.

In another embodiment, the oblong or rectangular support member is at least 20 inches wide and 4 feet long. In another embodiment, the oblong or rectangular support member is 2-4 feet wide and 4-8 feet long. In another embodiment, the length:width ratio of the oblong or rectangular support member is greater than 2. In another embodiment, the length:width ratio of the oblong or rectangular support member is 2.5 to 4.0.

The corners of an oblong-shaped support member can be of any shape known in the art. In addition to being rectangular (edges meeting at 90° angles), one or more corners can be cut off or angled (such that the oblong is pentagonal, hexagonal, heptagonal or octagonal), or the corners can be rounded or curved.

The upper surface of the support member is preferably smooth with no protrusions, so that a patient can be gently slid or maneuvered across the upper surface without being hampered or impeded by the surface. Since human skin, especially the skin of elderly patients, is friable and easily injured, such a surface minimizes the risk of injury when the patient is transferred from one generally horizontal surface to another, using the patient transfer device of the invention. Any smooth, non-stick, anti-friction and/or anti-static coating or treatment (e.g., TEFLON®, GORE-TEX®, etc.) known in the art can be applied to the upper surface of the support member to promote smooth, low-friction, unimpeded sliding or gliding of objects (e.g., a patient) across the upper surface or to make the upper surface more slippery.

5.2. Handle Means

The patient transfer device comprises a plurality of handle means, 5 (FIGS. 1-2, 5), situated on the first and/or the second side of the support member. Handle means can be any suitable handle known in the art, although preferably, the handle means is an aperture, an indentation, a groove or other non-protruding handle means in the support member. Such handle means that are flush with, or that do not protrude from, the upper surface of the support member, can enable the smooth, low-friction, unimpeded sliding or gliding of objects (e.g., a patient) across the upper surface.

In one embodiment, the handle means is an aperture that extends between the upper and lower surfaces of the support member. Preferably, the aperture is of dimensions such that the user's four fingers (i.e., the index, middle, fourth ("ring") and fifth ("pinky") fingers) can be inserted through the aperture from the upper surface of the support member to the lower surface and grasp the handle means, with the thumb grasping the lower surface of the support member. In another embodiment, the handle means is an indentation or groove on the upper or lower surface of the support member that one or more human fingers can grasp.

In another embodiment, handle means are non-protruding or have a low profile so that an object, such as a human being, can be slid across the upper surface of the support member and over the handle means unimpeded. In another embodiment, handle means are integral to (e.g., molded into) the support member.

In another embodiment, handle means are affixed to the support member by any method known in the art, e.g., by screwing, clamping, riveting, gluing, etc.

Handle means can be an aperture or a slot in the support member capable of admitting a human hand, e.g., approximately 1 inch wide and 4 inches long. In a specific embodiment, the aperture, 5, is situated in the support member on a side of the support member, and runs approximately parallel to the first or second edge of the support member (see FIGS. 1-2 and 5). According to this embodiment, handle means that are apertures are disposed on the support member so that they are not located above rolling means. Thus when the user's hand grasps through or around the aperture, the hand does not come in contact with rolling means underneath on the lower surface of the support member.

While aperture(s) are illustrated in FIGS. 1-2 and 5 as handle means, other handle means known in the art, including but not limited to non-protruding or low-profile metal handles, plastic handles, and integral molded handles, are all suitable for use in the invention.

In one embodiment, a plurality of handle means is situated on a single side (the first side or the second side) of the support member (see FIG. 5). In another embodiment, the plurality of handle means is situated on both sides of the support member (see FIGS. 1-2). The plurality of handle means allows one or more persons to grasp the patient transfer device on one side and pull a patient borne on the device (the patient in, for example, a prone or supine position or lying on one side) from one generally horizontally disposed surface to another, such as from bed to bed, bed to stretcher, stretcher to gurney, etc.

The plurality of handle means comprises individual handle means that are spaced along the first side, the second side, or both sides of the support member so that they can be grasped by persons of varying shoulder widths. The handle means are spaced, using ergonomic principles and knowledge commonly known in the art, so that they can be grasped by a person's hands with the hands being transversely spaced approximately the same distance as the person's shoulders.

In one embodiment, a plurality of handle means, 5 (FIGS. 1-2 and 5), is situated on a side of the support member about 1-2 inches medial from one or both of the lateral edges of the support member, an arrangement that enables easy grasping of the handle means. In the embodiment depicted in FIGS. 1-2 and 5, each handle means is a 1-inch by 4-inch aperture situated in the support member one inch medial to the first edge of the support member and spaced along the first side at 12 inches, 23 inches, 29 inches and 37 inches, running in an anterior-posterior direction, and parallel to the long axis of the support member.

5.3. Fastening Means

The patient transfer device comprises fastening means for securing the object to be transferred to the upper surface of the support member. In one embodiment, the fastening means is a plurality of pairs of fastening means, each of the pairs of fastening means comprising a first fastening means having a first end and a second end and a second fastening means having a first end and a second end wherein i. the first end of the first fastening means of each of the pairs of fastening means is attached to the first side of the support member, ii. the first end of the second fastening means of each of the pairs of fastening means is attached to the second side of the support member, iii. the second end of the first fastening means is capable of attaching across the upper surface of the support member to the second end of the second fastening means, and iv. the second end of the second fastening means is capable of attaching across the upper surface of the support member to the second end of the first fastening means across the upper surface of the support member.

The first end of the first or second fastening means of each pair of fastening means can be permanently or removably attached or affixed to a side, corner or edge of the support member on either its upper or lower surface, using any suitable method known in the art, e.g., by screwing, clamping, gluing, riveting, etc. The attachment point for the first end is preferably disposed on the upper or lower surface of the support member so that it does not impede a patient (or other object to be transferred) sliding over the upper surface of the support member. FIG. 2 depicts one embodiment of the invention, in which the attachment points for first ends of the fastening means, 12, are disposed on the lower surface of the support member and are located on the edge, and extend medially about 1-2 inches in from the edge of the support member. FIG. 5 depicts another embodiment of the invention, in which the attachment points for first ends of the fastening means, 12, are attached to the corners of the support member and extend out about 1-2 inches from the edge of the support member.

Fastening means can be any suitable flexible, finite length strap or belt known in the art. For example, the strap can be a stretcher, gurney or backboard strap such as those commercially available (e.g., from EMS Medical Products, Los Alamitos, Calif.; Morrison Medical, Columbus, Ohio; Strapworks.com, Eugene, Oreg.). Preferably, the strap is made of strong and durable webbing such as polypropylene, cotton, nylon, or polyester webbing (see, e.g., National Webbing Products Co., Garden City Park, N.Y.). The strap is of a suitable width and length, as known in the art, to accomplish whole body immobilization. In a specific embodiment, the strap is 2" wide and 4-6 feet long.

In one embodiment, the plurality of pairs of fastening means is at least two pairs of straps. In another embodiment, the plurality of pairs fastening means is three pairs of straps.

In a specific embodiment, the plurality of pairs of fastening means is two pairs of straps: a first pair and a second pair of straps (i.e., a total of four straps). Each of the four straps is attached to one of the four corners of the support means. The straps are oriented so that they extend diagonally across the upper surface of the support member: one member of the first pair of straps is attached to the upper corner of the first side and extends diagonally across the support member to fasten to the other member of the first pair attached to the lower corner of the second side. One member of the second pair of straps is attached to the upper corner of the second side and extends diagonally across the support member to fasten to the other member of the second pair attached to the lower corner of the first side. With such arrangement of fastening means, the patient can be slid or maneuvered across the upper surface of the support member without encountering, or being impeded by, the fastening means In another embodiment, the plurality of fastening means is two pairs of straps (FIG. 1). The first strap of a given pair of straps is attached or affixed to the first side of the support member and second strap of the pair is located opposite the first, on the second (opposite) side of the support member. Each strap extends across the upper surface of the support member and fastens to the other member of the pair on the opposite side (see FIG. 1, pair of straps 6*a* and 6*b*). Pairs of straps are spaced along the length of the support member at suitable intervals so that they can immobilize a patient in supine or prone (or lying on one side) position.

In another embodiment, a pair of straps is located 16 inches posterior to the anterior edge (head) of the support member and a second pair of straps is located 44 inches anterior to the posterior (foot) of the support member.

In another embodiment, one member of a pair of straps can clip or attach to the other member of the pair with a fastener, buckle or clip located at the "free" or second end of the strap, i.e., the end of the strap that is not attached or affixed to the support member. Fasteners suitable for use in the invention include, but are not limited to, a metal push button buckle, metal cam buckle, metal roller buckle, metal drop jaw buckle, metal D-ring fastener, metal swivel speed clip, metal non-swivel speed clip, plastic side release fastener, plastic cam or lever fastener, LOOP-LOK™, FASTEX® buckle, and VELCRO® fastener.

Fastening means are preferably used that can be pulled snugly and wrapped tightly around the patient, so that the patient is positioned securely and with sufficient force, against the upper surface of the support member so that the patient is immobilized. Such a hold-fast arrangement is preferred to minimize movement, discomfort or injury to the patient while being transferred.

5.4. Rolling Means

The patient transfer device of the invention comprises a plurality of rolling means, 8 (FIGS. 2-5), for translating the support member across the generally horizontally disposed surface, wherein the plurality of rolling means is positioned on the lower surface of the support member. In one embodiment, the rolling means is an omnidirectional ball roller, which is commonly known in the art and commercially available. In a specific embodiment, the rolling means is an omnidirectional solid thermoplastic resin (e.g., acrylic) roller ball within a housing, such as those employed in various roller and massage devices (e.g., Omni Massage Systems, Odessa Tex.). In this specific embodiment, each ball roller unit weighs about 5 oz.

Rolling means are preferably light, strong, with each roller weighing about 5 oz or less. In one embodiment, the entire patient transfer device, including the support member, straps, handle means and rolling means, weighs less than 20 lbs.

While a plurality of solid acrylic balls is illustrated in FIGS. 1-2 as a plurality of rolling means, other rolling means known in the art, including but not limited to rollers, wheels and casters (such as those commercially available from National Caster Corporation, Bedford Heights, Ohio) are also suitable for use in the invention. Such rolling means are preferably capable of omnidirectional function.

For example, rolling means suitable for use in the invention can be an omnidirectional roller ball surrounded by ball bearings encased within a housing, or an omnidirectional roller wheel or a ball caster (such as those available from Active Robots Limited, Somerset BA3 4JE, UK).

In another embodiment, the rolling means is an omnidirectional roller that has a housing molded into the lower surface of the support member. Molding of housings in the lower surface of the support member can be accomplished using routine methods in the art. In one embodiment the support member is an extruded thermoplastic synthetic resin such as polymethylmethacrylate, and the housing is formed in the lower surface of the support member using routine methods for extrusion molding of the thermoplastic synthetic resin.

In another embodiment, the rolling means, including any housing surrounding the roller, is affixed to the lower surface, e.g., with fixing screws.

The plurality of rolling means can be distributed on the lower surface of the support member using any suitable distribution pattern known in the art.

In one embodiment, the plurality of rolling means is distributed in an anterior to posterior direction in parallel rows along the first and second sides of the lower surface of the support member. In another embodiment, the plurality of rolling means is distributed on the lower surface in rows running parallel to the first or second edges of the support member.

For example, on each of the first and second sides of the support member, a row of rolling means can be positioned on the lower surface 1 inch medial to the corresponding (first or second) edge, with rolling means spaced from anterior to posterior at approximately 3 inch intervals (FIGS. 2-3). Another row can be positioned on the lower surface 3 inches medial to the corresponding (first or second) edge, with rolling means spaced from anterior to posterior at approximately 3 inch intervals, or a row can run along the anterior-posterior axis (midline) of the support member (see FIG. 2).

In the embodiment depicted in FIG. 2, there are three rows of rolling means (8), one row positioned along the midline and one row positioned on each side of the lower surface of the support member and running anterior to posterior. The anterior-most rolling means in each row is positioned at least 1 inch in from the anterior edge and the posterior-most rolling means in each row is positioned at least 1 inch in from the posterior edge. In the embodiment depicted in FIG. 2, rolling means are omnidirectional ball rollers, and a plurality of 33 ball rollers are arranged in three rows on the lower surface 9 of the support member. In this diagram, the ball rollers depicted are 3 inches in diameter and distributed at evenly spaced intervals so that within a row running anterior-posterior, there is a 2-3-inch (identical) space between each roller (from the edge of one roller to the beginning of the next) and a 2-4 inch (identical) space between rows (from the edge of one roller to the beginning of the next). There is at least a 1-inch space between the first edge and the row of ball rollers running along the first side, at least a 1-inch space between the second edge and the row of ball rollers running along the second side, and at least 1-inch spaces between the anterior-most roller and the anterior edge and the posterior-most roller and the posterior edge.

In the embodiment depicted in FIG. 5, the support member is 20 inches wide and 65 inches long. The rolling means, 8, which are omnidirectional ball rollers approximately 3 inches in diameter, are arranged in four parallel anterior-posterior rows on the lower surface, 9, of the support member. Each rolling means is spaced 3 inches apart. The lateral edge of one row of rolling means (an "edge" row), 13, is situated 1 inch medial to the first edge on the first side, and the lateral edge of another row of rolling means (another "edge" row), 14, is situated 1 inch medial to the second edge on the second side. Two additional "interior" rows of rolling means (15, 16) run anterior-posterior, and are disposed lateral to the midline, one row running anterior-posterior on the first side and one row running anterior-posterior on the second side. There is a 2-inch space between the interior row (15, 16) on each side and the edge row (13, 14) on each side. There is a 1-inch space between the anterior edge and the first rolling means in each row, and 1-inch space between the posterior edge and the last rolling means in each row. In this embodiment, the fastening means are straps that attach to the corners (12) and fasten diagonally. Handle means, 5, are situated 1 inch medial to the first edge on the first side at 12 inches, 23 inches, 29 inches and 37 inches posterior to the anterior edge. In another embodiment, a second, corresponding set of handle means is situated 1 inch medial to the second edge on the second side at 12 inches, 23 inches, 29 inches and 37 inches posterior to the anterior edge. An enlarged view of one of the handle means, 5, a 1-inch wide by 4-inch long aperture, is shown in the upper left.

In another embodiment, at least two rolling means are attached to each of at least two rails positioned on the lower surface of the support member. In another embodiment, at least two rolling means are housed inside of, or confined to, a pair of closely spaced parallel rails that form a rail housing, allowing the rolling means to slide within or through the rail housing. The rail housing can be enclosed at each end, to confine the rolling means within the rail housing.

In another embodiment, at least one rail is positioned on the first side on the lower surface, and at least one rail is positioned on the second side on the lower surface, so that each rail is running parallel (or nearly parallel) with the first and second (i.e., left and right) edges of the support member and lateral to the midline of the support member. In a specific embodiment, at least 6 rolling means are attached to (or enclosed within) each rail.

In a specific embodiment, rails run anterior to posterior along a portion of the length (or the entire length) of the support member on its lower surface. One rail is positioned on the lower surface of the first side, running roughly parallel to, and 2 inches medial to, the first edge, The other rail is positioned on the lower surface of the second side, running roughly parallel to, and 2 inches medial to, the second edge.

In another specific embodiment, rails run across a portion (or all) of the width of the support member on its lower surface. One rail is positioned on the lower surface 2 inches posterior to the anterior edge, and the other rail is positioned on the lower surface 2 inches anterior to the posterior edge.

The suitability of the distribution pattern of rolling means and the support provided thereof can be evaluated using routine methods. For example, a force comparable to that exerted by the object to be transferred (e.g., a human being) can be exerted on a prototype support member bearing a plurality of rolling means in the distribution pattern to be evaluated, and the support member's response to the force (in terms of flexing, sagging, etc.) can be measured using routine methods. For example, breaking strength, the tensile load or force required to crack, break or rupture the support member, can be measure (e.g., in terms of lb/in of width), according to ASTM standards. Strength of polymethylmethacrylate can be tested, for example, using the methods described in S. I.

Mikitishin, A. N. Tynnyi, and Z. A. Bazilevich (1971), Strength of irradiated polymethyl methacrylate, Materials Science 4(4), 337-339.

5.5. Operation of the Patient Transfer Device

The invention provides a method for transferring an object to and from a generally horizontally disposed surface using the patient transfer device described herein. In one embodiment, the method comprises:

providing a transfer device, wherein the transfer device comprises a generally flat and semi-rigid support member adapted to be orientated in a generally horizontal disposition having i. a first edge, ii. a first side disposed medial to the first edge, iii. a second edge, wherein the second edge is opposite the first edge, iv. a second side disposed medial to the second edge, wherein the second side is opposite the first side, v. an upper surface, and vi. a lower surface, wherein the lower surface is opposite the upper surface;

a plurality of handle means;

fastening means; and a plurality of rolling means for translating the support member across the generally horizontally disposed surface, wherein the plurality of rolling means is positioned on the lower surface of the support member;

positioning the upper surface of the device under the object whereby the object is fully supported by the device; and rolling the device to (or from) the generally horizontally disposed surface, thereby transferring the object from (or to) the generally horizontally disposed surface.

In one embodiment, the invention provides a method for transferring a patient from one side of a generally horizontal surface to the other, or from one generally horizontal surface to another generally horizontal surface, such as from bed to bed, from one side of a bed to the other side of the bed, from stretcher to gurney or bed (or vice versa), and for similar patient relocation under circumstances where the patient must remain in a supine (or prone or lying on one side) position. For example, while a patient is lying supine (or prone or on one side) on a generally horizontal surface such as bed, gurney, stretcher, examination or x-ray table etc., the patient transfer device is positioned close to or adjacent to the generally horizontal surface and then inserted (with the upper surface facing up) under a portion of the patient's body so that a portion of the upper service of the device is in contact with, and supporting, the patient's body.

The patient transfer device can be inserted, for example, beneath the legs, buttocks and pelvic area of the patient. By supporting, lifting, sliding, rolling and/or guiding the patient above or over the patient transfer device, the device is maneuvered, slid, or rolled up under the patient in a posterior-anterior direction towards the patient's head, until the device fully extends beneath and supports the patient on its upper surface.

The patient transfer device can also be inserted laterally under one side of a supine (or prone or lying on one side) patient. By supporting, lifting, sliding and/or guiding the patient above or over the patient transfer device, the device is maneuvered, slid or rolled up under the patient towards the opposite side of the patient, until the device fully extends beneath and supports the patient on its upper surface.

Accordingly, the patient can subsequently be moved using the patient transfer device, by rolling the device laterally or longitudinally along the generally horizontal surface on which the patient is positioned or from a first generally horizontal surface to a second generally horizontal surface positioned near or adjacent to the first surface, by a single individual with a minimum of effort. For example, the patient transfer device can be positioned under a patient in a bed so that the device fully extends beneath and supports the patient on its upper surface. A gurney is then positioned next to one side of the bed and adjusted to be at the same height as the upper surface of the mattress of the bed. The patient transfer device is then rolled laterally from the side of the bed onto the gurney.

To remove the patient transfer device once the patient has been moved to the desired location, the steps for inserting the patient transfer device under the patient can be reversed. By supporting, lifting, sliding and/or guiding the patient above or over the patient transfer device, the device is maneuvered, slid or rolled out from under the patient.

The present invention is not to be limited in scope by the specific embodiments described herein. Indeed, various modifications of the invention in addition to those described herein will become apparent to those skilled in the art from the foregoing description. Such modifications are intended to fall within the scope of the appended claims.

All references cited herein are incorporated herein by reference in their entirety and for all purposes to the same extent as if each individual publication, patent or patent application was specifically and individually indicated to be incorporated by reference in its entirety for all purposes.

The citation of any publication is for its disclosure prior to the filing date and should not be construed as an admission that the present invention is not entitled to antedate such publication by virtue of prior invention.

What is claimed is:

1. A device for transferring an adult human user to and from a generally horizontally disposed surface comprising:

a. a generally flat and semi-rigid support member adapted to be orientated in a generally horizontal disposition, of a size adapted to support substantially the whole body of an adult user, having i. a first edge, ii. a first side disposed medial to the first edge, iii. a second edge, wherein the second edge is opposite the first edge, iv. a second side disposed medial to the second edge, wherein the second side is opposite the first side, v. an upper surface, and vi. a lower surface, wherein the lower surface is opposite the upper surface;

b. a plurality of handle means positioned on the sides of the support member;

c. a plurality of fastening means for fastening an adult human user to the upper surface; and d. a plurality of omnidirectional ball rollers for translating the support member across the generally horizontally disposed surface, wherein the plurality of ball rollers are positioned in cylindrical extensions extending downwardly from the lower surface of the support member, wherein the plurality of ball rollers are distributed in an anterior to posterior direction in parallel rows along the first and second sides of the lower surface of the support member.

2. The device of claim 1 wherein the support member comprises a thermoplastic synthetic resin.

3. The device of claim 1 wherein the support member is ⅛ to ¼ inch thick.

4. The device of claim 1 wherein the support member is 20 inches wide and 65 inches long.

5. The device of claim 1 wherein the handle means is an aperture in the support member 1 inch wide and 4 inches long.

6. The device of claim 1 wherein the fastening means is a plurality of pairs of fastening means, each of the pairs of fastening means comprising a first fastening means having a first end and a second end and a second fastening means having a first end and a second end wherein a. the first end of the first fastening means of each of the pairs of fastening means is attached to the first side of the support member, b. the first end of the second fastening means of each of the pairs of fastening means is attached to the second side of the support member, c. the second end of the first fastening means is capable of attaching across the upper surface of the support member to the second end of the second fastening means, and d. the second end of the second fastening means is capable of attaching across the upper surface of the support member to the second end of the first fastening means across the upper surface of the support member.

7. The device of claim 6 wherein the plurality of pairs of fastening means is at least two pairs of straps.

8. The device of claim 7 wherein the second end of the first strap and the second end of the second strap of one pair of finite length straps are capable of attaching to one another diagonally.

9. The device of claim 1 wherein the omnidirectional ball rollers are a solid thermoplastic resin ball rollers.

* * * * *

UNITED STATES PATENT AND TRADEMARK OFFICE

CERTIFICATE OF CORRECTION

PATENT NO. : 7,478,444 B1
APPLICATION NO. : 11/586123
DATED : January 20, 2009
INVENTOR(S) : James Darrigo It is certified that error appears in the above-identified patent and that said Letters Patent is hereby corrected as shown below:

On the Cover page, at paragraph (74) *Attorney, Agent or Firm.* Please delete the word "Marajama" and replace therefor with --Marjama--.

Signed and Sealed this

Seventh Day of April, 2009

JOHN DOLL
*Acting Director of the United States Patent and Trademark Office*